United States Patent [19]

Sasao

[11] Patent Number: 4,614,931

[45] Date of Patent: Sep. 30, 1986

[54] CALL SIGNAL CONVERSION APPARATUS FOR ELEVATOR SYSTEM

[75] Inventor: Isao Sasao, Inazawa, Japan

[73] Assignee: Mitsubishi Denki Kabushiki Kaisha, Tokyo, Japan

[21] Appl. No.: 359,859

[22] Filed: Mar. 19, 1982

[30] Foreign Application Priority Data

Jun. 11, 1981 [JP] Japan ..... 56-89816

[51] Int. Cl.[4] ..... G08B 5/36

[52] U.S. Cl. ..... 340/19 R; 340/20; 187/29 R

[58] Field of Search ..... 340/19 R, 20, 21; 187/29 R

[56] References Cited

U.S. PATENT DOCUMENTS 3,967,700 7/1976 Tur et al. ..... 340/21 X 4,120,381 10/1978 Otto et al. ..... 340/19 R X 4,376,930 3/1983 Sasao ..... 340/20 X

*Primary Examiner*—John W. Caldwell, Sr.

*Assistant Examiner*—Ellwood G. Harding

*Attorney, Agent, or Firm*—Oblon, Fisher, Spivak, McClelland & Maier

[57] ABSTRACT

A call system for an elevator includes a call button and call registration lamp connected to two electrodes of a thyristor. The third electrode is connected to a conversion circuit. The conversion circuit is connected to a control device. The control device determines whether the call signal is to be effective at a given time. The conversion circuit receives the call signal and the indication of effectiveness and forwards the call signal to the control device only when the signal is to be effective. The conversion device includes a memory for storing the state of effectiveness, a call signal detecting circuit and a driving circuit.

4 Claims, 9 Drawing Figures

CALL SIGNAL CONVERSION APPARATUS FOR ELEVATOR SYSTEM

BACKGROUND OF THE INVENTION

1. Field of the Invention

The present invention relates to an improved call signal conversion apparatus for an elevator system.

2. Description of the Prior Art

The elevator system equipped with a digital apparatus such as a computer needs to have hall call buttons and car call buttons and registration lamps which are connected with the buttons to turn-on with each call signal and a signal conversion circuit of converting the call signal to a control device of the computer.

The apparatus having a call detection circuit and a call registration lamp-operating circuit as shown in FIG. 1 has been proposed as the signal conversion circuit (U.S. Pat. No. 4,376,930).

In FIG. 1(*a*), the reference numeral (1) designates a call button; (2) designates a call registration lamp; (3) designates an elevator control device. The call buttons (1) and the call registration lamps (2) are connected in series between a power source terminal P and the earth. The connected point (a) of them is connected through a common signal wire (7) for transmitting the call signal and call registration signal to the detection circuit (5) and the call registration lamp-operating circuit (6) for the call signal conversion circuit (4). The call signal conversion circuit (4) and the elevator control device (3) are connected to transmit the signals to each other.

In FIG. 1(*b*), the signal lines for the call button (1) and the call registration lamp (2) are separated to be capable of cutting service to selected floors. The call button (1) is connected through the call signal line (7*a*) between the call detection circuit (5) and the earth. The call registration lamp (2) is connected through the signal line (7*b*) between the call registration lamp-operating circuit (6) and the power source terminal P. Between the call signal conversion circuit (4) and the elevator controlling device (3), the transmission of the signal is imparted depending upon the call data.

In the apparatus having the above-mentioned structure, the call detection circuit (5) comprises a detection device for detecting the call signal from the call button (1) and a logic circuit for transmitting the call data to the control device (3) depending upon the data requiring timing of the control device (3). When the control device (3) receives the call data from the call detection circuit (5), the call data is memorized (registered) and the turn-on command for turning on the corresponding call registration lamp (2) is transmitted to the call registration lamp-operating circuit (6) depending upon the registration. The call registration lamp circuit (6) is controlled by the logic circuit for controlling call registration lamps and an operating circuit controlled by the output of the logic circuit. Thus, the call registration lamp (2) is turned on by receiving the command of the control device (3) into the call registration lamp circuit (6).

In the circuit having the structure shown in FIG. 1(*a*), the call button (1) and the call registration lamp (2) are connected in series to the power source. Even though the call registration is not desired (referred to as a floor where service is cut), the call registration lamp (2) is turned on during the operation of the call button (1). Therefore, it is not clearly indicated whether service is cut to the floor or not. Thus, this causes unreliable feeling for passenger and this is not suitable for controlling the elevator system.

In the conventional system, in order to overcome the problem when the service is cut, the call signal line (7*a*) and the call registration signal line (7*a*) are separated in the circuit as shown in FIG. 1(*b*) whereby the detection of the call button (1) and the control of the call registration lamp (2) are independently performed. However, twice as many signal lines than exist in the structure shown in FIG. 1(*a*) are needed in the latter structure. The three kinds of signals needed are the car call, the up hall call and down hall call. Therefore, 6 signal lines are needed for one floor in the structure shown in FIG. 1(*b*). The number of the lines is increased in proportional to the number of the elevator service floors whereby the cost and processes for construction are disadvantageously increased.

SUMMARY OF THE INVENTION

It is an object of the present invention to overcome the above-mentioned disadvantages and to provide a call signal conversion apparatus for transmitting a call signal and a call registration control signal by a common signal line under the condition that call registration lamp is not turned on by an actuation of a call button during the cut in service to a particular floor in an elevator system.

The foregoing and other objects of the present invention have been attained by providing a call signal conversion apparatus for an elevator system which comprises a call button device made of a call button and a call registration lamp in one body which turns on a call registration lamp by a call button signal and maintains the turn-on state; an elevator control device comprising a computer which outputs a control signal for selecting effectiveness or noneffectiveness of said call button signal and inputs and registers the call signal in the case of effectiveness; a signal conversion circuit connected between said call button device and said elevator control device and said signal conversion circuit comprising a circuit for detecting said call signal, a memory circuit for memorizing effectiveness or noneffectiveness of said call button actuation or a turn-off state of call registration lamp, and a driving circuit for detecting the output of said memory circuit to output a signal for the effectiveness or noneffectiveness of the call button actuation or the turn-on state of said call registration lamp.

DETAILED DESCRIPTION OF THE PREFERRED EMBODIMENTS

Referring to FIGS. 2 to 6, one embodiment of the present invention will be illustrated.

Figure 1:
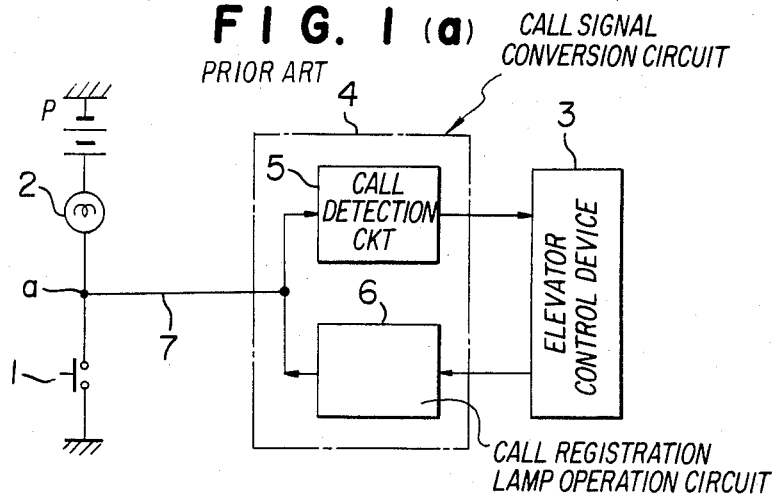
FIG. 1 (a) PRIOR ART
FIG. 1 (*a*), (*b*) are block diagrams of a conventional call signal conversion apparatus for an elevator system.
Figure 1:
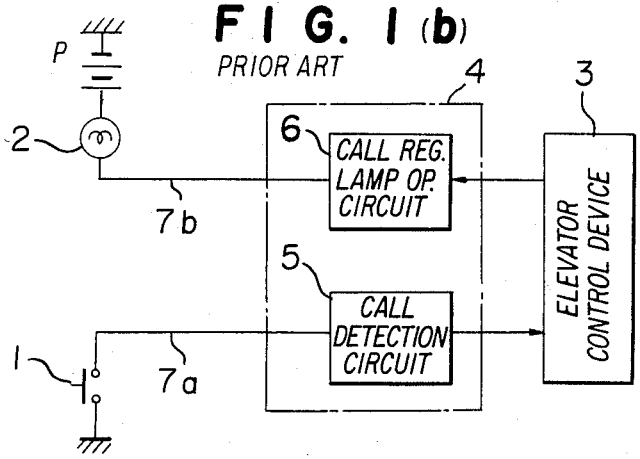
FIG. 1 (b) PRIOR ART
Figure 2:
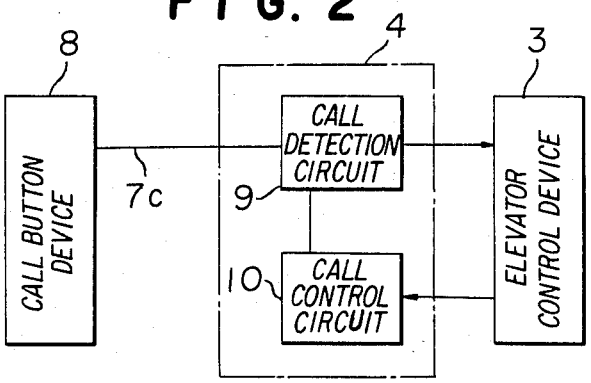
FIG. 2 is a block diagram of one embodiment of a call signal conversion apparatus according to the present invention.

FIG. 2 shows a block diagram of the call signal conversion apparatus for an elevator system of the present invention.

A call signal conversion circuit (4) comprises a call detection circuit (9) and a call control circuit (10). A call button device (8) including call buttons and call registration lamps is connected through a common signal line (7*c*) to the call signal conversion circuit (4) and is connected to an elevator control device (3) for receiving data from the call signal conversion circuit (4) or transmitting data to it.

Figure 3:
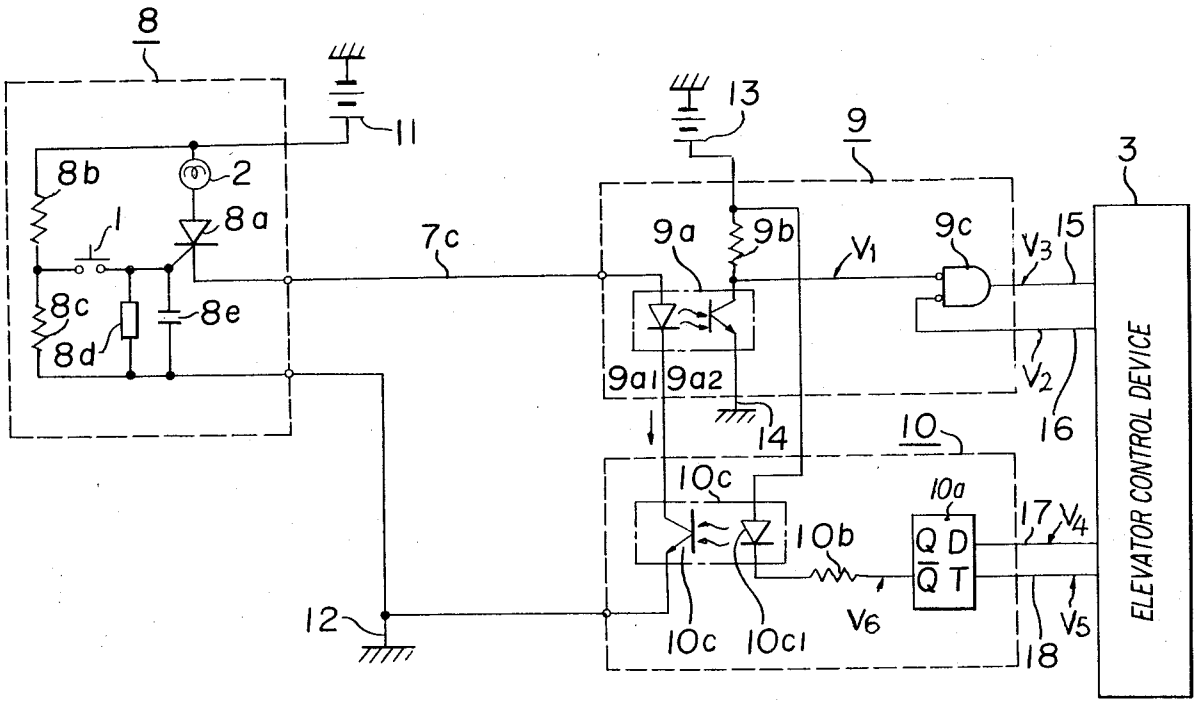
FIG. 3 is a circuit diagram of a call button device and a signal conversion circuit of the embodiment shown in FIG. 2.

FIG. 3 shows an embodiment of the circuit shown in FIG. 2. The call button device (8) made of the call buttons (1) and the call registration lamp (2). The call registration lamp (2) is connected between a positive terminal (11) of a DC power source (such as DC 100 V) and an anode of a thyristor (8*a*) for controlling the operation of the lamp (2). The cathode of the thyristor (8*a*) is connected to the common signal line (7*c*). The call button (1) is connected between the gate of the thysistor (8*a*) and a connecting point of bias resistors (8*b*), (8*c*) for setting a gate voltage and a gate current. A resistor (8*b*) and a capacitor (8*e*) for stabilizing the operation of the thyristor (8*a*) are connected in parallel between the gate and the earth terminal (12) of the thyristor (8*a*). The call detection circuit (9) includes a photo-coupling device (9*a*) of a photodiode ($9a_1$) and a phototransistor ($9a_2$) and a dual inverted input AND gate (9*c*) The photo-coupling device (9*a*) is used for detecting the call signal and controlling an electric connection of the call button device (8). The anode of the photodiode ($9a_1$) is connected to the common signal line (7*c*). The collector of the phototransistor ($9a_2$) is connected through a resistor (9*b*) to a positive terminal (13) of a DC power source for a logic circuit. The emitter of the phototransistor ($9a_2$) is connected to the ground terminal (negative terminal) (14). The collector of the phototransistor ($9a_2$) is connected to the input terminal of the AND gate (9*c*). A call data demand timing signal is fed from the elevator control device (3) through a signal line (16) to the other input terminal of the AND gate (9*c*). The call signal transmitted from the AND gate (9*c*) is fed through the signal line (15) to the elevator control device (3).

The call control circuit (10) includes a flip-flop (10*a*), and a photo-coupling device (10*c*) of a photodiode ($10c_1$) is used for detecting the output condition of the flip-flop (10*a*), transmitting the signal for controlling the call button device (8) and controlling the electric connection to the call button device (8).

The anode of the photodiode ($10c_1$) is connected to the DC power source terminal (13) and the cathode of the photodiode ($10c_1$) is connected through the resistor (10*b*) to the $\overline{Q}$ terminal of the flip-flop (10*a*). The collector of the phototransistor ($10c_2$) is connected to the cathode of the photodiode ($9a_1$) of the photo-coupling device (9*a*) and the emitter of the phototransistor ($10c_2$) is connected to the ground terminal of the call registration lamp operating power source. The data input terminal D of the flip-flop (10*a*) is connected through the signal line (17) to the elevator control device (3) and the timing input terminal T is also connected to the elevator control device (3).

Figure 4:
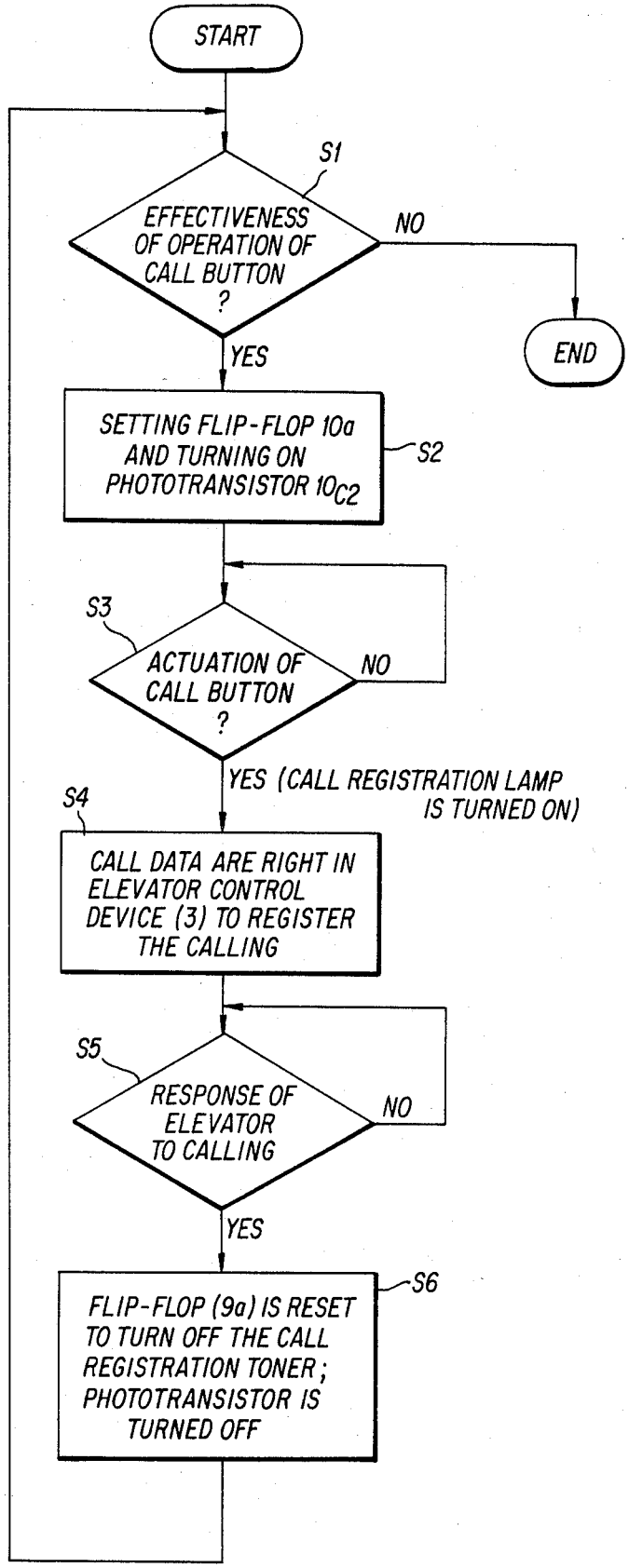
FIG. 4 is a flow chart for illustrating the operation of the apparatus of the present invention.
Figure 5:
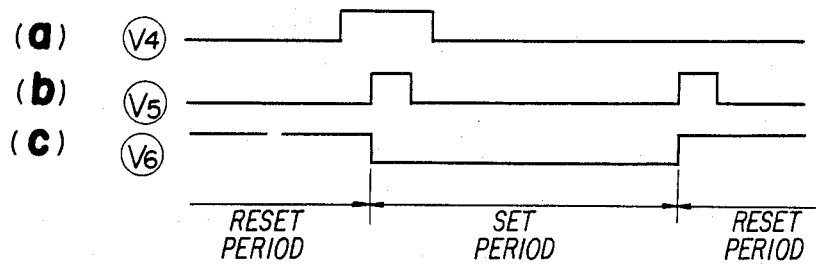
FIGS. 5 and 6 are timing charts for illustrating the operation of the circuits shown in FIG. 3.
Figure 6:
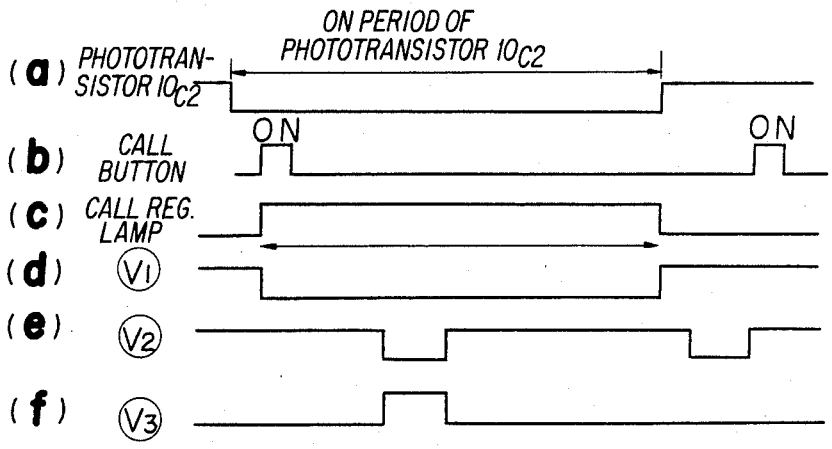

Referring to FIGS. 4 to 6, the operation of the apparatus having the above-mentioned structure of the present invention will be illustrated.

FIG. 4 shows the basic flow chart for controlling the call button apparatus (8), the call detection circuit (9) and the call control circuit (10) by the elevator control device (3).

The effectiveness or noneffectiveness (no response of the elevator to the calling) of the corresponding call button actuation is selected in the step $S_1$ by a predetermined input of the elevator control device 3. In the case of the effectiveness, it is shifted to a step $S_2$. As shown in the timing chart, the set signals $V_4$, $V_5$ (both are in the level "H") are respectively transmitted from the elevator control device (3) through the signal lines (17), (18) under the timings shown in FIG. 5 (*a*), (*b*). Thus, the flip-flop (10*a*) is set. The level of the $\overline{Q}$ output $V_6$ is changed in "L" to ground the photodiode whereby the current from terminal 13 is fed to the photodiode ($10c_1$) and the photodiode ($10c_1$) is actuated to result in the light emission of the phototransistor ($10c_2$) is turned on.

If the call button (1) is turned on in the timing shown in FIG. 6(*b*) during the period in ON state of the phototransistor ($10c_2$) shown in FIG. 6(*a*), and this is determined as a step $S_3$, the thyristor (8*a*) is turned on thereby forming a circuit of power source terminal (11)-call registration lamp(2)-thyristor (8*a*)-photodiode ($9a_1$)-phototransistor ($10c_2$)-earth terminal (12). Thus, the call registration lamp (2) is turned on as shown in FIG. 6(*c*) to pass a current I to the photodiode ($9a_1$). Since, the DC power is constantly applied to the terminal (11) the thyristor (8*a*) is maintained in ON state even though the call button (1) is deactuated. Thus, the phototransistor ($9a_2$) is turned on to form a circuit of power source terminal (13)-resistor (9*b*)-phototransistor ($9a_2$)-ground terminal (14). Therefore, the collector potential $V_1$ of the phototransistor ($9a_2$) is changed to "L" (calling) as shown in FIG. 6(*d*).

In the ON state, if a data demand signal $V_2$ is transmitted from the elevator device (3) through the signal line (16) under the timing shown in FIG. 6(*e*), the level of the signal $V_3$ is changed to "H" (FIG. 6(*f*)) in the case of the level "L" of the signal $V_1$ of the AND gate (9*c*). The data are transmitted through the signal line (15) to the elevator control device (3). On the other hand, the data of non-calling $V_3$="L" are transmitted in the case of the level "H" of the signal $V_1$. In the elevator control device (3), the call signal is registered (memorized) and is held until there is a response (corresponding to step $S_4$ in FIG. 4) to the call. In the step $S_5$, if the response to the registered calling is considered to be made, the reset signals $V_4$="L" $V_5$="H" are output from the elevator control device (3) to turn off the call registration lamp (2) and the flip-flop (10*c*) is reset whereby the level of the $\overline{Q}$ output of the flip-flop (10*c*) is changed to "H" and the current of the photodiode ($10c_1$) is interrupted and the phototransistor ($10c_2$) is simultaneously turned off (corresponding to the step $S_6$ in FIG. 4) thereby interrupting the circuit of terminal (11)-call registration lamp (2)-thyristor (8*a*)-signal line (7*c*)-photodiode ($9a_1$)-phototransistor ($10c_2$)-ground terminal (12) to turn off the thyristor (8*a*) and to turn off the call registration lamp (2).

If the call button (1) is actuated in the ON state of the phototransistor ($10c_2$) of the call control circuit, the call registration lamp (2) is turned on and the call signal is transmitted through the call detection circuit (9) to the elevator control device (3). The call registration lamp (2) can be turned off by turning off the phototransistor ($10c_2$). In OFF state of the phototransistor ($10c_2$), the call registration lamp (2) is not turned on and the call signal is not transmitted even though the call button (1) is actuated.

Figure 7:
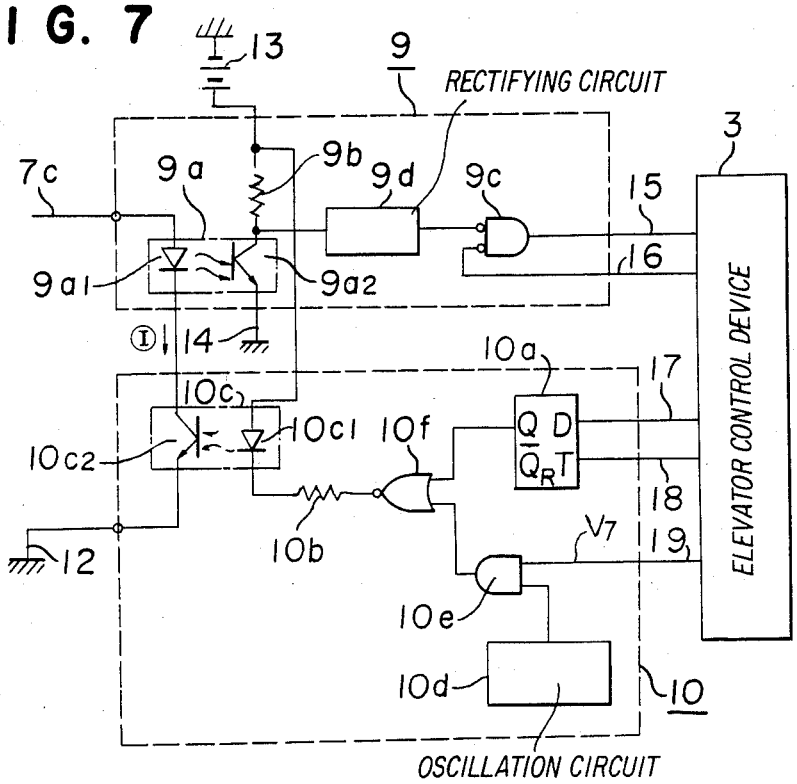
FIG. 7 is a circuit diagram of the other embodiment according to the present invention.

FIG. 7 shows the other embodiment of the present invention which has the function for detecting the call input needed for the control of the elevator system only when the call button (1) is actuated.

In the embodiment of FIG. 7 having the above-mentioned function, a rectifying circuit (9*d*) for converting a pulse train input into DC level, is connected to the call detection circuit (9) of FIG. 3 including the photo-coupling device (9*a*), the resistor (9*b*) and the AND gate (9*c*). The rectifying circuit (9*d*) is connected between the the collector of the phototransistor ($9a_2$) of the photo coupling device (9*a*) and one input terminal of the AND gate (9*c*). The call control circuit (10) comprises the flip-flop (10*a*), the resistor (10*b*) and the photo-coupling device (10*c*) as the parts shown in FIG. 3 and also an oscillator (10*d*) for repeating ON-OFF of the photo-coupling device (10*c*); an AND gate (10*e*) for determining effectiveness or noneffectiveness of the output of the oscillator (10*d*) by receiving a signal $V_7$ fed from the elevator control device (3) through the signal line (19) as one input; and an NOR gate (10*f*) for operating the photo-coupling device (10*c*) by the output of the AND gate (10*e*) or the output Q of the flip-flop (10*a*). The same references designate the identical or corresponding parts to FIG. 3.

Figure 8:
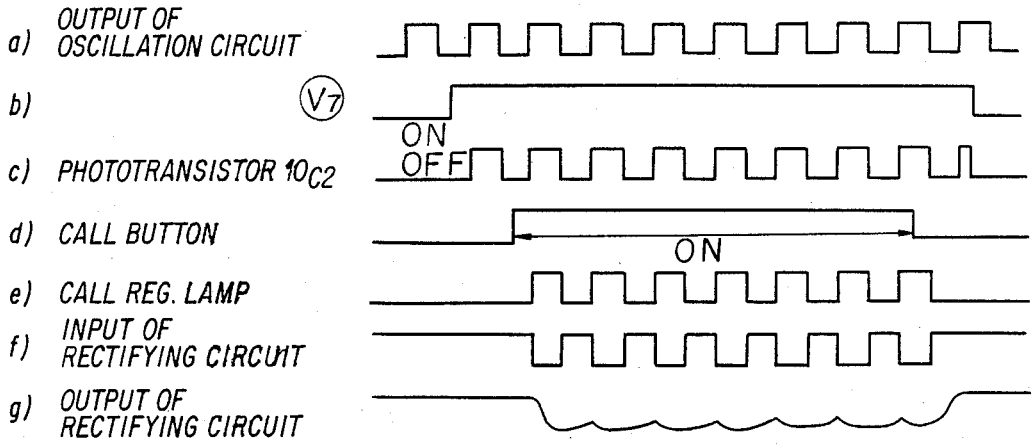
FIG. 8 is a timing chart for illustrating the operation of the embodiment shown in FIG. 7.

Referring to FIG. 8, the operation of the circuit of the embodiment of FIG. 7 will be illustrated.

The signal having the waveform of FIG. 8(*a*) is fed from the oscillator (10*d*) into one of the input terminals of the AND gate (10*e*). The signal $V_7$ of the elevator control device (3) is fed through the signal line (19) to the other input terminal of the AND gate (10*e*). When the signal $V_7$ is in the level "L", the output of the oscillator (10*d*) is noneffective and the call button device (8) and the call signal conversion circuit (4) perform the same operation of the embodiment shown in FIG. 3. The operation will not be repeatedly illustrated.

On the other hand, when the signal $V_7$ is in the level "H" as shown in FIG. 8(*b*), and the output Q of the flip-flop (10*a*) is in the level "L" (reset state), namely, in the situation where the call button is non-effective, the call detection circuit (9) detects the calling during the time actuating the call button (1) as shown in FIG. 8(*d*) When the oscillation output of the oscillator (10*d*) is applied through the AND gate (10*e*), the NOR gate (10*f*) and the resistor (10*b*) to the cathode of the photodiode ($10c_1$), the level of the cathode is changed to "H" or "L" depending upon the oscillation output. Thus, the photodiode ($10c_1$) performs intermittent light emission under synchronization to the oscillation frequency thereby repeating ON-OFF of the phototransistor ($10_2$). If the call button (1) is actuated under the condition, the call registration lamp (2) is flashed under synchronizing to the oscillation frequency of the oscillator (10*d*) under the timing shown in FIG. 8(*c*). The collector potential as the input to the rectifying circuit (9*d*) has the waveform shown in FIG. 8(*f*). The rectifying circuit (9*d*) repeatedly converts the signal into the DC level to give the output shown in FIG. 8(*g*).

If the call button (1), is deactuated, the thyristor (8*a*) of the call button device (8) is turned off under synchronizing to the timing for turning off the phototransistor ($10c_2$) and the call signal is eliminated. The call signal is not output until the call button (1) is actuated again. Thus, the call signal is detected during the time actuating the call button (1). This operation is not performed if the output Q of the flip-flop (10*a*) is in the level "H" even though the signal $V_7$ is in the level "H". The same operation of the embodiment shown in FIG. 3 is performed.

In the embodiments shown, a circuit for making one call is shown. In a practical situation, n circuits would be needed for n calls from different floors.

In the description of the embodiment, a photocoupling device is used for electrical control of the transmission and receiving systems for the call button device (8). However, in the call detection, it is possible to directly receive the signal by a transistor. The call control output can be directly given by an output of an integrated circuit.

The memory circuit is formed by the D flip-flop having D and T terminals in the embodiments. However, it is possible to use the other memory device such as R-S or J-K flip-flop.

As the signal between the call signal conversion circuit (4) and the elevator control device (3), an inverted signal can be utilized instead of the signals shown in FIGS. 5, 6 and 8. The inverted signal can be easily given by connecting an inverter and using an NAND gate and an AND gate. A coded signal can be used in place of the timing signal. The coded signal can be easily given by connecting a decoder to the signal conversion circuit (4). The amplifier can be inserted between devices if desired. The distance between the call button device (8) and the signal conversion circuit (4) is usually in a range of about 100 to 200 m. There is a possibility to incorporate the external noise in the signal line. In order to overcome the external noise problem, it is possible to connect a noise absorber to the input or output terminal if desired.

In accordance with the present invention, the call button and the call registration lamp are in one-body and the call registration lamp is turned on by the button operation and the signal conversion circuit connected between the call button device and the elevator control device is formed by a detection circuit for detecting the call signal and the memory circuit for memorizing the effectiveness or noneffectiveness of the call button operation or the OFF state of the call registration lamp and the circuit for operating the call button device by the output of the memory circuit in the call control circuit. Therefore, it is possible to overcome both the disadvantages of the conventional system for transmitting the call signal and the call registration lamp signal through one common signal line and the disadvantage of the conventional system for transmitting them by independent signal lines. In the conventional system, two kinds of the apparatus are used depending upon the needs. However, it is possible to use one common device without using either of the conventional kind. In the structure of the invention, the call registration lamp is not directly operated by the call signal conversion circuit. Therefore, a device having less power consumption can be used in the call signal conversion circuit. Moreover, a high voltage is not applied in the signal lines. Therefore, a device requiring low voltage can be used. The circuits can be simplified and the cost of the call conversion apparatus can be reduced.

What is claimed as new and desired to be secured by Letters Patent of the United States:

1. An elevator system, comprising:

a call device containing a call button for producing a call signal and a call registration lamp in one unit;

a control device for receiving an indication of when a call signal is to be effective and for receiving said call signal when effective;

a conversion apparatus connected between said call device and said control device for receiving an effectiveness signal from said control device indicating whether said call signal is to be effective and said call signal from said call device and for sending to said control device said call signal when effective;

said conversion apparatus including a call signal detecting circuit for receiving said call signal, a memory circuit for receiving said effectiveness signal and storing said signal and, a driving circuit for detecting the presence of said stored signal in said memory circuit; and said call device further including a thyristor, the anode of said thyristor being connected to one side of said call registration lamp, the other side of said call registration lamp being connected to a power source, the cathode of said thyristor being connected to said conversion apparatus, the gate of said thyristor being connected to one side of said call button, the other side of said call button being connected to a circuit for feeding a gate current to said thyristor.

2. The improved elevator system of claim 1 wherein said conversion apparatus further comprises a rectifying circuit for converting a pulse train input into DC level connected between said circuit for detecting said call signal and said elevator control device; and an oscillator circuit controllably connected between said driving circuit and said elevator control device.

3. The improved elevator system according to claim 1 wherein said circuit for detecting said call signal includes a first photo-coupling device for detecting said call signal and controlling the electrical connection of said call button device.

4. The improved elevator system of claim 3 wherein said driving circuit consists of a second photocoupling device for detecting the output of said memory circuit and controlling the electrical connection of said call button device.

* * * * *